US006735912B2

(12) United States Patent
Riggio

(10) Patent No.: US 6,735,912 B2
(45) Date of Patent: May 18, 2004

(54) METHOD AND APPARATUS OF WEATHER SEALING ADJACENTLY JOINTED BUILDING PANELS

(76) Inventor: Steve Riggio, 10450 River Rd., Barrington Hills, IL (US) 60102

( * ) Notice: Subject to any disclaimer, the term of this patent is extended or adjusted under 35 U.S.C. 154(b) by 0 days.

(21) Appl. No.: 09/682,887

(22) Filed: Oct. 30, 2001

(65) Prior Publication Data

US 2003/0079426 A1 May 1, 2003

(51) Int. Cl.[7] ..... E04B 2/88

(52) U.S. Cl. ..... 52/235; 52/461; 52/469; 52/730.3; 52/741.4

(58) Field of Search ..... 52/235, 395, 204.53, 52/204.54, 204.62, 468, 469, 491, 464, 730.3, 741.3, 741.4, 746.1

(56) References Cited

U.S. PATENT DOCUMENTS

| | | | | | |
|---|---|---|---|---|---|
| 3,341,999 | A | | 9/1967 | Berg | |
| 3,694,984 | A | * | 10/1972 | Schwartz | 52/204.593 |
| 3,791,088 | A | | 2/1974 | Sandow et al. | |
| 3,864,886 | A | | 2/1975 | Thom | |
| 4,117,640 | A | * | 10/1978 | Vanderstar | 52/204.593 |
| 4,418,506 | A | * | 12/1983 | Weber et al. | 52/209 |
| 4,423,572 | A | | 1/1984 | Tor | |
| 4,428,171 | A | * | 1/1984 | Harbin | 52/204.593 |
| 4,524,978 | A | * | 6/1985 | Mauser | 52/718.02 |
| 4,608,793 | A | * | 9/1986 | Yost et al. | 52/235 |
| 4,756,132 | A | * | 7/1988 | Newman et al. | 52/235 |
| 4,977,716 | A | * | 12/1990 | Hawkins | 52/235 |
| 5,076,034 | A | | 12/1991 | Bandy | |
| 5,216,855 | A | | 6/1993 | Richter et al. | |
| 5,259,162 | A | | 11/1993 | Nicholas | |
| 5,309,689 | A | * | 5/1994 | Croissant | 52/235 |
| 5,338,130 | A | * | 8/1994 | Baerveldt | 404/33 |
| 5,426,897 | A | | 6/1995 | Gazaway | |
| 5,481,839 | A | * | 1/1996 | Lang et al. | 52/235 |
| 5,553,422 | A | | 9/1996 | Gazaway | |
| 5,592,795 | A | * | 1/1997 | Rinehart et al. | 52/235 |
| 5,687,524 | A | | 11/1997 | Ting | |
| 6,014,846 | A | | 1/2000 | Sono et al. | |

FOREIGN PATENT DOCUMENTS

| | | |
|---|---|---|
| EP | 339778 | * 11/1990 |
| GB | 2075079 | * 11/1981 |

* cited by examiner

*Primary Examiner*—Winnie S. Yip
(74) *Attorney, Agent, or Firm*—Bullwinkel Partners, Ltd.

(57) ABSTRACT

A method and apparatus for sealing the joints, using a unified protective joint cap, of jointed building panel systems having a plurality of building panels. The unified sealing member is applied on top of the jointing means of the panel system wherein no modifications or alternations of the jointing means is required. As such, the protective joint cap may be applied directly to a jointing system in need of repair without the requirement of resealing the jointing system. Furthermore, the protective joint cap does not require an anchoring means to be installed prior to application. The protective joint cap further preferably contains an incorporated extrusion suitable for maintaining a bead of liquified elastomeric sealant, such as RTV, which may be applied prior to the sealing member's installation.

14 Claims, 1 Drawing Sheet

METHOD AND APPARATUS OF WEATHER SEALING ADJACENTLY JOINTED BUILDING PANELS

BACKGROUND OF INVENTION

The present invention relates generally to a method and apparatus of weather sealing joints between common adjacently jointed building panels to prevent water intrusion from the exterior into the interior of said joints. More specifically, the present invention relates to a method and apparatus of applying a resilient joint capping member upon an existing or new jointed building panel structure without the need to first prepare, modify or alter the joint, in order to enhance appearance, integrity and resistance to water permeability such that exterior water is prevented from reaching potentially leak prone joints from which it could subsequently penetrate to the interior of the structure.

The background of the invention, as discussed below, focuses on adjacently joined window panels. However, it should be understood, of course, that the limitations, problems and techniques discussed herein apply to all types of conventional adjacently joined building panel products, such as curtain panel walls, paneled roofing, and the like. As such, the discussion of adjacently joined window panels should not be construed as a limitation, but rather as a simplified explanation of the background of the invention which applies to all conventional adjacently joined building panel products and materials.

Many buildings and architectural designs now incorporate the usage of a plurality of adjacently jointed window panels in order to achieve a desired aesthetic goal while further enhancing the amount of incoming natural light and "openness" appearance of the interior of the building. For example, this technique can be witnessed in the construction and utilization of atrium skylights, glass window walls, and the like, all of which achieve their intended goal by utilizing numerous glass panels adjacently connected together.

Inherent with the usage of numerous adjacently jointed window panels, intersections between such panels are ubiquitous. The construction of these joints, however, must allow some flexibility and resiliency. For example, the joining technique used must allow the adjoined panels to naturally expand and contract due to temperature variations, as well as allow minute flexible movement due to building settlement and the like. Conventionally, multiple windows of such a configuration are connected using window mullions. These mullions interactively allow two adjacently connected window panels to be structurally joined together without the need of requiring connection apertures, such as screw holes, within the window panels, which would subsequently decrease the structural integrity of such window panels, introduce added locations of water permeation, and increase installation and material costs.

As such, conventional window mullions employ a technique that utilizes a bottom plate portion and a top plate portion between two adjacently joined window panels. The top and bottom plate portions are fixedly connected together and subsequently sandwich the windows together, typically with a threaded screwing means, which uses compression mechanics to ensure a structurally sound connection. Typically, where the mullion meets the window glass surface, resilient gaskets or other sealing membranes are utilized to ensure a weather-tight seal. Furthermore, it is also quite frequent that the installation laborers will enhance the weather-sealing performance of the mullion by manually applying, in a liquid form, a resilient elastomeric sealant, such as an RTV silicone polymer, at the window panel joint line and/or where the mullion supports the window panel surface.

However, inherent with such weather-sealing installation techniques, the initial seal integrity and quality is dependent upon field workmanship. Since field quality integrity is almost always impossible to ensure due to lack of adequate supervision and unpredictable installation techniques, the installed seals are generally prone to varying installation errors. These errors may range from inadequate preparation of the surface, improper application of the sealant, incorrect type of sealant, and the like. Furthermore, even if the initial weather-seal and mullion were properly installed, the seal material itself is relentlessly beleaguered by natural elements, such as rain, snow, freezing, ultra-violet radiation from sunlight, minute building movements and settlement, environmental contaminants, and the constant expansion and contraction of the adjacent window panels themselves. Also, the mullion outside surface is subjected to the same weather elements, and, as such, frequently corrodes and requires replacement or frequent maintenance due to drastically decreased structural integrity and unfavorable appearance. As such, it is inevitable that the mullion gaskets and seals, as well as the mullion outside surface, will eventually fail, thus causing water leakage and related problems. The only way to prevent such failures is to implement frequent joint repairs or to address the issue when such a leakage problem arises.

Frequently, such joint repairs require another manual application of liquid elastomeric sealant at the joint line and where the mullion supports the glass panel surface. However, as can be evidenced from above, this solution is short lived and will once again have to be re-done in the near future. Furthermore, the mullions themselves, also needing frequent maintenance, need to be repainted to protect them from environmental and weather elements. As such, especially since this technique of maintenance is labor intensive and quite repetitive, it is often quite expensive and does not solve the problem.

The present invention overcomes these limitations by providing an easily installable mullion and joint resilient protective cap, which negates the need to repaint and/or reseal the mullion and joint. The present invention is also a longer-term solution when compared to the conventional technique of re-sealing all of the window panel joints. Furthermore, the resilient cap, being placed on top of the existing mullion and joint seal structure elements, protects the mullion from further environmental damage.

U.S. Pat. No. 5,687,524, to Ting, issued on Nov. 18, 1997 ('524), discloses an apparatus for sealing the intersecting panel joints of building surfaces. The '524 patent is a multiple element system which ensures a weather-tight seal around the building panel joints. An inner member must first be fixedly attached to the joint location as well as be weather-sealed to ensure a water-tight seal. As disclosed in the '524 patent, the inner member is bolted to the joint using the existing joint connection device. The inner member further contains a plurality of upwardly protruding vertical legs with inwardly angled edges, which will act as the mating surface to the later applied outer member. An outer member, in the form of the protective joint cap and with a plurality of downwardly protruding vertical legs spaced apart approximately the same distance as the inner member vertical legs, is attached to the inner member by a snapping mechanism. The '524 patent further discloses an optional sealant which may be applied to the portion where the outer member intersects the surface of the building panel. This optional sealant enhances the apparatus' ability to provide a water-tight seal. However, a limitation to the '524 patent is the requirement of a multiple member system. The process of fixedly attaching an inner member to the joint connection is time consuming and within a window panel environment connected by conventional window mullions, is dangerous. The present invention overcomes these limitations by, for example, not requiring a multiple member installation. Furthermore, the present invention does not require any type of fixedly attached anchoring system, which must first be installed prior to the protective cap installation, thus not requiring modification of the existing joint structure.

U.S. Pat. No. 3,341,999, to Berg, issued on Sep. 19, 1967 ('999), discloses an arrangement for installing battens on paneled roofs and walls. The '999 patent consists of a batten, acting as a joint cap, with a cross-sectional contour in the shape of an arch with pier portions turned inward in order to form guide strips. Furthermore, a batten holder, in the shape of a "U" and being designed to readily receive the guide stripes of the batten, must first be fixedly attached to the desired joint location using the disclosed attachment device. The batten is then attached to the batten holder via the guide strips. A limitation of the '999 patent is that the batten holders must first be fixedly attached to the joint location. As with the '524 patent, this process is not readily useful in existing window joint weather-sealing applications, as such a process is dangerous and labor intensive. Furthermore, the '999 patent apparatus is not resilient by nature. As such, the '999 apparatus is more susceptible to future failure due to environmental elements as well as the natural expansion and contraction mechanics of glass panels. Lastly, the '999 patent does not provide a water-tight weather seal where the batten legs meet the surface of the jointed panels. As such, water can easily seep between the batten and panel surface intersection, thus eventually reaching the protected joint. The present invention overcomes these limitations by, for example, readily applying the weather-sealing protective cap directly to the surface of the adjacent glass panels without the need to modify the joints with an additional mounting element. As such, since the present invention is a unified, one-piece unit, its integrity is greatly enhanced wherein the possibility of functional failure is greatly decreased. Furthermore, the present invention is preferably resilient, thus being more readily adaptable to varying weather related conditions, as well as inherent adjacent glass panel movements. Lastly, the present invention provides a water-tight seal where the protective joint cap intersects with the surface of the jointed panels.

U.S. Pat. No. 3,864,886, to Thom, issued on Feb. 11, 1975 ('886), discloses a cover assembly for structural joints. The '886 patented apparatus requires an anchoring device, which readily receives the protective cap cover, to be fixedly attached to one of the jointed panel members. A "U" shaped protective cap cover, with a protruding middle portion, then is attached to the anchoring device, preferably using spring clips via the protruding middle portion. The end portions of the "U" shaped protective cap member, which intersect the surfaces of the panel members, has a resilient material applied at the surface intersection location to ensure weather-proofing capabilities. A limitation of '886 patent is that it is once again a multiple member system with an anchoring member which must be fixedly attached to at least one jointed panel surface. The present invention overcomes this limitation by, for example, not requiring an independent anchoring member that must be fixedly attached to at least one of the jointed panel surfaces.

U.S. Pat. No. 5,259,162, to Nicholas, issued on Nov. 9, 1993 ('162), discloses a multi-functional wall cover for architectural joints. The '162 patent utilizes a single element joint protective cap which is fixedly attached to the surface of at least one of the adjacent jointed panels. Alternately, the protective cap can be held in place by utilizing an attachment device, which uses a compression force within the joint between the jointed panels to enhance stability. The protective cap further intersects the surfaces of the adjacent panels with a resilient material in order to enhance water-proofing. A limitation of the '162 patent is it requires that at least one aperture be retained for mounting purposes. As such, this aperture decreases the water-proofing integrity of the capping system by introducing yet another location where water seepage may occur. Furthermore, the protective cap must be fixedly attached to at least one of the adjacent jointed panel surfaces. The present invention overcomes these limitations by, for example, not requiring the protective cap to be fixedly attached to one of the jointed panels. Furthermore, the present invention does not have any aperture located on its surface that can present a location of future water seepage.

The present invention overcomes the disadvantages and/or shortcomings of known prior art jointed panel protective caps and provides a significant improvement thereover.

SUMMARY OF INVENTION

It is therefore an object of the present invention to provide an effective and economical method and apparatus for water-sealing jointed panel building materials without the undue burden and expense of requiring highly skilled laborers.

It is another object of the present invention to provide a protective joint cap member which does not necessitate any type of existing joint modification or alteration.

It is a further object of the present invention to utilize a one-element system which subsequently enhances the water-sealing integrity and reliability of the jointed seal.

It is yet another object of the present invention to provide a protective joint cap apparatus which can be applied without being connectively attached with an independent anchoring device to the surface of any jointed panel member.

It is yet another object of the present invention to provide a protective joint cap member which is resilient enough to be usable in varying weather conditions and yet allow the natural movements of the expansion and contraction processes of building materials while still maintaining its sealing and structural integrity.

The present invention is a joint protective cap intended to be applied along the joint of jointed adjacent panel building materials. The protective cap is applied as a single unit, which does not require an independent anchoring member or any type of modifications to the sealed joint itself. The present invention is constructed preferably of a resilient elastomeric material, which enhances its integrity and allows for expansion and contraction of the jointed panels without affecting the protective caps operation and integrity.

The present invention is preferably cross-sectionally shaped in an inverted "U" configuration wherein the end of each independent leg portion is turned, in a preferably outward direction, in order to form two independent protrusions which are perpendicular to said leg portions. Furthermore, the preferred embodiment of the present invention has a plurality of downwardly protruding resilient members located approximately in the middle of the inverted "U" configuration. It is intended that these protruding resilient members will provide an enhanced water sealant around any protruding bolts or attachment devices which may be present within the jointed system. The present invention thus completely covers the joint, with any existing joint system left in place, without the need for further preparation to the joint system, and provides a water-tight seal where the outwardly extended leg portions intersects the surface of the jointed building panels, preferably with a resilient sealant, such as a liquified elastomeric sealant.

The present invention is preferably utilized in a multiple jointed glass panel application, such as a multi-paneled sunroof or a glass wall; however, its useful application can be applied to all conventional panel building materials, such as paneled curtain walls, paneled roofs and the like. The present invention can either be installed during the initial construction and jointing of the paneled building materials or it is preferably installed as a maintenance application to existing joints and joint systems. Since the present invention does not require any type of existing joint system modification or extensive jointed panel surface preparation, the present invention provides an effective and cost efficient maintenance application for existing jointed seals.

BRIEF DESCRIPTION OF DRAWINGS

The preferred embodiment is herein described in detail with references to the drawings, where appropriate, wherein.

DETAILED DESCRIPTION

Figure 1:
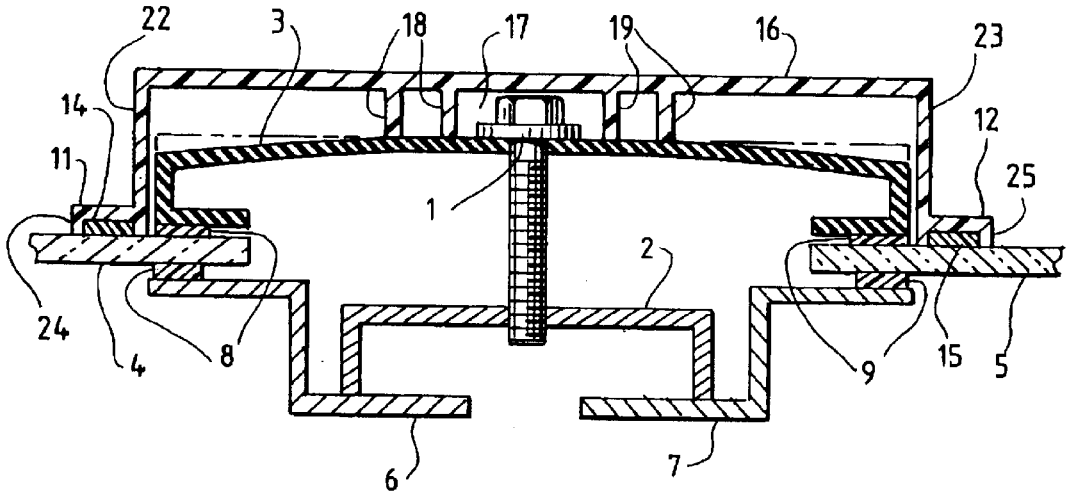
FIG. 1 is a schematic cross-sectional view depicting the preferred embodiment of the present invention as applied upon a conventional jointed panel configuration.

Referring to FIG. 1, the preferred embodiment of the present invention is a unified protective joint cap 16 to be used on new or preferably existing jointed panel building materials 4, 5. The present invention is preferably employed with conventionally jointed glass panels 4, 5, which incorporate a typical glass connecting mullion connecting system 1, 2, 3, 6, 7. Alternately, the present invention can be used with curtain panel walls, paneled roofing, or any other type of paneled building construction application. Furthermore, the present invention can be utilized in any orientation, such as vertically, horizontally, inclined, or inverted.

The present invention protective joint cap 16 has a preferably uniform cross-section shaped in an inverted "U" configuration, thus having a plurality of parallel, independent leg portions 22, 23. Alternate embodiments of the present invention can be cross-sectionally shaped in different configurations depending upon the desired appearance, economics, or configuration of the existing joint connecting system. Preferably, the present invention is constructed of a resilient elastomeric material, such as silicone rubber.

Figure 2:
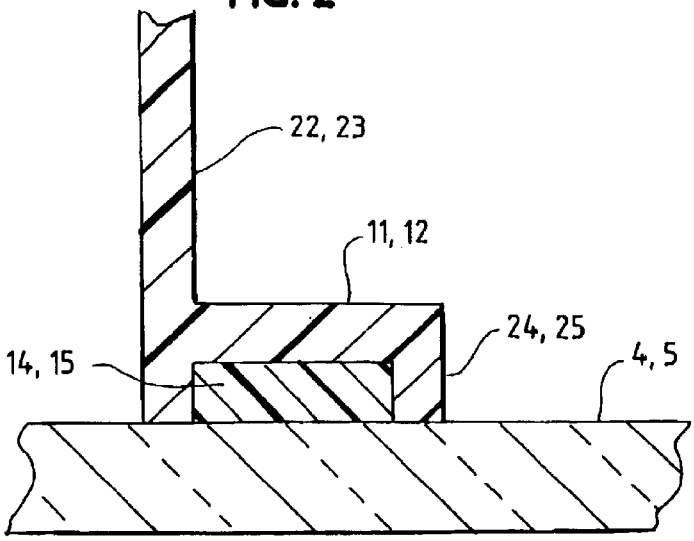
FIG. 2 is a detailed cross-sectional view depicting the present invention's independent legs with the preferred foot portion defining a sealant reservoir.

Referring to FIGS. 1 and 2, in the preferred embodiment of the present invention, near the termination of each independent leg portion 22, 23 is an outwardly protruding foot portion defining a reservoir, preferably as an inverted "L" shaped member 11, 12 wherein the short leg 24, 25 of the "L" shaped member 11, 12 extends to the same plane as does the end of the parallel, independent leg portions 22, 23. Alternately, the present invention may incorporate an outwardly protruding member with protrusion legs 11, 12 the same length as legs 24, 25. Preferably, the first leg 11, 12 of the protruding foot portion runs approximately perpendicular to the leg portion 22, 23 to which it is attached. At the end of the perpendicular leg is attached a second leg 24, 25 which runs approximately parallel to the same leg portion 22, 23 to which the first leg 11, 12 is attached. This subsequently creates the preferred inverted "L" shaped member. The "L" shaped member 11, 12 subsequently forms a reservoir 14, 15 for an elastomeric sealant located where the protective joint cap 16 intersects the surface of the adjacently jointed panels 4, 5. Such elastomeric sealant is preferably RTV (room temperature vulcanizing) silicone rubber and is preferably manually placed within the sealant reservoir 14, 15 at the job site location prior to the protective joint cap 16 installation. The sealant reservoir 14, 15 and building panel 4, 5 surface intersection will thus provide a water-tight seal upon placement of the surface of the jointed panels 4, 5. Alternately, the sealant reservoir 14, 15 may have sealant incorporated therein during manufacturing, wherein no manual application will be required in the field.

Further alternately, the "L" shaped member 11, 12 can be inverted and protrude inwardly, still forming a sealant reservoir and achieving the same results. Still alternately, the present invention may simply outwardly turn the end of each independent leg section into a flange, wherein such flange is perpendicular to the independent leg section 22, 23 but does not have a liquified sealant reservoir. As such, upon placement of the protective joint cap 16, a liquified sealant can be manually placed at the intersection of the alternate flange and the surface of the jointed building panel members 4, 5.

The preferred embodiment of the present invention further entails a plurality of spaced apart, parallel, and downwardly protruding bolt sealing members 18, 19 which encase the connecting means of the joint connecting system by each contacting the top portion of the joint connecting system further enhancing the water-tight seal against the top joint connecting member 3 and providing structural support for the protective joint cap 16. The bolt sealing members 18, 19, in turn, form an internal cavity 17 to receive the connecting means 1 (a bolt is shown) of the joint connecting system. However, if no connecting means is present in the joint connecting system, the preferred embodiment can still be utilized as depicted while still achieving the same results.

The intent of the preferred embodiment of the present invention is a maintenance application with existing jointed panels requiring such maintenance. However, alternately, the present invention can be utilized as an initial jointed panel joint sealing device when the joint is new. Application in both scenarios is the same. As such, with the preferred embodiment of the present invention, any existing jointed panel seals 8, 9 can be left in place and do not require modification prior to placement of the protective joint cap 16. Furthermore, since the protective joint cap 16 has the ability to completely cover the existing joint connecting system, no preparation or modifications are needed to the joint connecting system, including modifications or preparation to connecting means head 1 (bolt head shown).

The present invention is preferably formed and constructed of a resilient material, such as RTV silicone rubber, which is better adapted to withstand extreme and varying weather conditions and environmental contaminants. Furthermore, such a resilient material will allow minute building movements, such as settlement or expansion and contraction of connected building materials, to occur without breaching the integrity of the protective joint seal cap 16.

In summary, the present invention utilizes a unified protective joint seal cap 16 which is placed over the joint of jointed panels, preferably glass, to cover up existing leaky panel joints or new panel joints of an exterior building surface. The protective joint seal cap 16 completely covers any existing joint connecting system, such as a window mullion, and, as such, does not require any type of modification or alterations to such a system. Furthermore, since the protective joint seal cap 16 completely covers the existing joint connecting system, existing gaskets, and/or seals of the joint connecting system, even if they are deteriorated or failing, may be left in place, thus saving labor and time. The preferred embodiment of the present invention further contains sealant reservoirs 14, 15 located where the protective joint seal cap 16 intersects the surface of the jointed panel.

While preferred and alternate embodiments have been described herein, it is to be understood that these descriptions are only illustrative and are thus exemplifications of the present invention and shall not be construed as limiting. It is to be expected that others will contemplate differences, which, while different from the foregoing description, do not depart from the true spirit and scope of the present invention herein described and claimed.

What is claimed is:

1. A method of re-sealing the joints of an existing glass connecting mullion connecting system having a plurality of building panels, each said building panel interconnected to an adjacent said building panel by a joint connecting system, said joint connecting system having a top side, and each said building panel having an interior surface and an exterior surface, the method comprising the steps of:

a) creating a protective unified sealing member having a uniform cross-section sized to fit snugly over said joint connecting system, said uniform cross-section having a base, said base having an external side and an internal side, said internal side having a plurality of independent protruding legs, each said protruding legs having a termination;

b) preparing each said termination for an elastomeric sealant;

c) placing said protective unified sealing member over said joint connecting system, without altering or connectively attaching to said joint connecting system, with one said termination in contact with said exterior surface of said building panel and another said termination in contact with said exterior surface of an adjacent said building panel, each said termination thereby independently creating a contact location; and d) adhesively sealing said unified sealing member at said contact location with a liquid elastomeric sealant.

2. The method as claimed in claim 1 wherein said uniform cross-section is an inverted "U" shaped configuration.

3. The method as claimed in claim 1 where each said termination is turned to form a foot portion, said foot portion thereby creating a reservoir, said foot portion having a first leg and a second leg, said first leg extending approximately perpendicular to at least one said protruding member and having a fixed length with an end, said second leg connected to said end and extending parallel to at least one said protruding leg and terminating approximately on the same plane as at least one said protruding leg, said reservoir being of a size suitable to receive and retain a bead of said liquid elastomeric sealant.

4. The method as claimed in claim 3 wherein the step of preparing said termination for an elastomeric sealant further comprises the step of placing a bead of said liquid elastomeric sealant into said reservoir.

5. The method as claimed in claim 1 wherein said internal side of said base further comprises a plurality of independent protruding members, said protruding members being parallel to each other and approximately centrally located on said internal side of said base, said protruding members further being spaced apart to create a cavity of adequate size to receive said joint connecting system, and said protruding members being of a length suitable to intersect said top side of said joint connecting system after the step of placing said protective unified sealing member over said joint connecting system is conducted.

6. The method as claimed in claim 1 wherein said protective unified sealing member is made of a resilient material.

7. The method as claimed in claim 6 wherein said resilient material is silicone rubber.

8. The method as claimed in claim 1 wherein said liquid elastomeric sealant is room temperature vulcanizing silicone rubber.

9. A jointed building panel system protective joint cap apparatus, said jointed building panel system having a plurality of building panels, each said building panel interconnected to an adjacent said building panel by a joint connecting system, said joint connecting system having a top side, each said building panel having an interior surface and an exterior surface, said protective joint cap apparatus comprising:

a) a protective unified sealing member having a uniform cross-section sized to fit snugly over joint connecting system but not being connectively attached thereto, said uniform cross-section having a base, said base having an external side and an internal side, said internal side having a plurality of independent protruding members, each said protruding member having a termination; and b) said termination is turned to form a foot portion, said foot portion thereby creating a reservoir, said foot portion having a first leg and a second leg, said first leg extending approximately perpendicular to at least one said protruding member and having a fixed length with an end, said second leg connected to said end and extending parallel to at least one said protruding member and terminating approximately on the same plane as at least one said protruding member, said reservoir being of a size suitable to receive and retain a bead of liquid elastomeric sealant.

10. The apparatus as claimed in claim 9 wherein said uniform cross-section is an inverted "U" shaped configuration.

11. The apparatus as claimed in claim 9 wherein said internal side of said base further comprises a plurality of independent protruding members, said protruding members being parallel to each other and approximately centrally located on said internal side of said base and being spaced apart to create a cavity of adequate size to receive said joint connecting system, and said protruding members being of a length suitable to intersect said top side of said joint connecting system after placing said protective unified sealing member over said joint connecting system is conducted.

12. The apparatus as claimed in claim 9 wherein said protective unified sealing member is made of a resilient material.

13. The apparatus as claimed in claim 12 wherein said resilient material is silicone rubber.

14. The apparatus as claimed in claim 9 wherein said reservoir has a bead of said liquid elastomeric sealant incorporated therein.

* * * * *